United States Patent [19]

Larson

[11] Patent Number: 4,555,103

[45] Date of Patent: Nov. 26, 1985

[54] BOTTOM LEVEL SHEET FEEDING APPARATUS

[75] Inventor: Bradley W. Larson, Garland, Tex.

[73] Assignee: The Mead Corporation, Dayton, Ohio

[21] Appl. No.: 607,851

[22] Filed: May 7, 1984

Related U.S. Application Data

[63] Continuation-in-part of Ser. No. 529,455, Sep. 6, 1983.

[51] Int. Cl.[4] ..... B65H 3/04; B65H 7/02; B65H 3/56

[52] U.S. Cl. ..... 271/35; 271/258; 271/10; 271/117; 271/121

[58] Field of Search ..... 271/4, 10, 23, 35, 37, 271/117, 118, 110, 111, 121, 124, 256, 257, 258, 259, 260, 262, 263, 273, 274

[56] References Cited

U.S. PATENT DOCUMENTS

| | | | |
|---|---|---|---|
| 3,108,801 | 10/1963 | Van Dalen | 271/34 |
| 3,768,803 | 10/1973 | Stange | 271/34 |
| 3,934,869 | 1/1976 | Strobel | 271/35 |
| 4,030,722 | 6/1977 | Irvine et al. | 271/111 |
| 4,074,902 | 2/1978 | Bradbury | 271/258 |
| 4,174,102 | 11/1979 | Clausing | 271/35 |
| 4,192,497 | 3/1980 | Perun et al. | 271/121 |
| 4,457,656 | 7/1984 | Kosina et al. | 271/273 |

FOREIGN PATENT DOCUMENTS

| | | | |
|---|---|---|---|
| 1216329 | 5/1966 | Fed. Rep. of Germany | 271/35 |
| 0102761 | 8/1979 | Japan | 271/274 |
| 0042435 | 3/1982 | Japan | 271/122 |
| 0135041 | 8/1983 | Japan | 271/35 |
| 0183541 | 10/1983 | Japan | 271/118 |
| 373945 | 1/1964 | Switzerland | 271/35 |

OTHER PUBLICATIONS

Kirksey, J. R. et al., "Paper Feed Roll . . . ", IBM Technical Disclosure Bulletin, vol. 20, No. 11B, Apr. 1978, p. 4883.

*Primary Examiner*—Bruce H. Stoner, Jr.
*Assistant Examiner*—James E. Barlow
*Attorney, Agent, or Firm*—Biebel, French & Nauman

[57] ABSTRACT

A bottom level sheet feeding apparatus having a tray for receiving a stack of sheets, a driven endless belt conveyor with an upstream end extending into the tray, a lead surface plate over a fixed-height idler roller to form a pinch point between the belt conveyor and the lower edge of the lead surface plate, a retard strip, and a pair of puller rolls for transporting fed sheets from the extreme downstream end of the belt conveyor to an appropriate copying mechanism. Both the upstream end of the belt conveyor and the downstream end of the belt conveyor may be lowered and raised relative to the fixed height idler roller. A solenoid or hydraulic piston arrangement is disclosed for lowering or raising the upstream and downstream ends of the belt conveyor.

6 Claims, 5 Drawing Figures

BOTTOM LEVEL SHEET FEEDING APPARATUS

CROSS-REFERENCE TO RELATED APPLICATIONS

This application is a continuation in part of my earlier application Ser. No. 529,455, filed Sept. 6, 1983, the disclosure of which is hereby incorporated by reference.

BACKGROUND OF THE INVENTION

This invention relates to document feeding apparatuses and, more particularly, it relates to an improvement in bottom level sheet feeding apparatuses.

Many modern, high speed copiers are capable of copying serially paginated booklets and the like, one page at a time, and presenting the copies as well as the copied pages in the proper sequential order. To accomplish this function, such devices commonly utilize bottom level document feeders which receive a stack of original documents to be copied, remove the lowermost sheet from the stack and convey it to the copying station. The advantage of a bottom level document feeder is that successive stacks of original sheets may be loaded into it, even as the sheets are being withdrawn from the lowermost stack, and the resultant copies and originals are presented in the same order in which they were loaded into the device.

There are many types of bottom level document feeders. For example, Strobel, U.S. Pat. No. 3,934,869, discloses a bottom level document feeder which includes a stack receiving tray, an endless belt conveyor partially extending into the tray, an abutment plate located downstream of the tray and above the belt, and a retard pad of the type disclosed in Stange, U.S. Pat. No. 3,768,803, located above the belt and downstream of the abutment plate. The abutment plate is oriented substantially perpendicularly to the portion of the belt conveyor which contacts and transports the sheets loaded onto the tray. The conveyor includes an idler roller located slightly upstream of the abutment plate and further upstream a belt roller which is located beneath the tray.

In operation, the conveyor urges a stack of sheets loaded onto the tray forwardly until their leading edges contact the vertical abutment plate. A gap beneath the plate allows the conveyor to displace a lowermost sheet or sheets forwardly beneath the abutment plate and into contact with the retard pad. The retard pad has a coefficient of friction sufficient to hold and thereby separate any additional sheets carried through the opening from the lowermost sheet and prevent their moving further with the lowermost sheet. Thus, only the lowermost sheet is conveyed past the retard pad by the belt, which has a coefficient of friction higher than that of the retard pad and thus can convey a sheet of paper past the retard pad.

Strobel also discloses the concept of connecting the upstream belt roller to a pivot arm for raising the belt. This feature is used to increase the surface area of the belt in contact with the bottom sheet of the stack for feeding sheets under abnormal conditions. Thus, a variable foot print feed belt is provided to accommodate varying sheet separating resistance.

Clausing in U.S. Pat. No. 4,174,102 also discloses a system for raising and lowering the upstream belt roller in a bottom level document feeder. In Clausing the upstream roller is an idler roll which is on a rotatable frame. When the lead edge of the bottom most sheet in a stack reaches the transport rolls, the frame carrying the idler roll is rotated so that the belt is removed from contact with the stack of sheets. When the trailing edge of the sheet being fed leaves the retard zone, the frame carrying the idler roll is rotated in the other direction so that the belt is again in contact with the bottom sheet of the stack. The apparatus is then ready to feed the next sheet and the lowering and raising cycle begins again. A baffle is used to maintain the proper entrance geometry when the belt is lowered away from the stack of sheets.

The stated purpose of raising and lowering the belt in the Clausing system is to prevent degradation of the retard pad, belt and sheet being fed. It is also stated that with the belt in its retracted position, away from the stack of sheets, the drive force on the next and subsequent sheets of the stack is very small and therefore the probability of multi-feed is reduced.

Thus, the systems of Strobel and Clausing are intended to overcome a problem inherent with many bottom level document feeding apparatuses; namely, that the conveying means for transporting the lowermost sheet from the stack within the paper tray often conveys more than a single sheet so that a number of sheets are conveyed past the retard station. This results in misfeeds and requires the sheet feeding operation to be stopped and the excess sheets removed from the apparatus downstream of the stack. An excessive number of such misfeeds results in significant downtime of the entire copying or duplicating machine, and possibly an unacceptable number of copy sheets which have either no text at all imprinted upon them, or text which is misregistered.

Another system for minimizing this problem is found in my copending application Ser. No. 529,455. As disclosed in that application, an idler roller is positioned to support the belt directly beneath a pinch point. The pinch point inhibits the passage of multiple sheets of paper and the system disclosed in my copending application, thus, reduces the overall number of misfeeds encountered.

It does not, however, totally eliminate them. Two problems remain. One is a problem termed reverse shingling. Reverse shingling occurs when the sheets in the stack, upon placement of the stack on the tray, slide relative to one another so that one of the upper sheets actually enters the pinch point first. Thus, the very bottom most sheet, which should be the first one to advance into the mechanism, is retained in the location of placement in the tray by the surface friction of the belt which extends partially into the tray. The upper sheets may then shift relative to that bottom sheets. This is true particularly when the stack of sheets is large and the surface friction between the sheets is low. This shifting may result in one (or more) of the upper sheets actually entering the pinch point first, i.e., out of order. If the sheet which does so is the second or third one in the stack, the corrective features provided by the retard pad should permit the bottom most sheet to catch up to and overtake the misfed lead sheet. However, if the sheet first entering the pinch point is actually the fifth or tenth one in the stack, the normal corrective features are not adequate. While an uncorrected misfeed caused by reverse shingling may occur only a small percentage of the time, it is still desirable to further minimize the problem.

The other possible problem is at the downstream end of the feed mechanism. It is desirable that the puller or transport rolls adjacent to the downstream end of the feed belt be independently driven. However, in that system if a misfeed occurs or if for some other reason the belt is to be stopped at a time when a sheet is in the nip of the puller or transport rolls, two situations can result, neither of which is desirable. If the drive for the belt is simply stopped, the puller or transport rolls which are independently driven will continue to pull the sheet therethrough and because the sheet couples to the belt by surface friction, the belt will continue to turn. On the other hand, if a brake is applied to the belt when the drive is stopped, the independently driven puller or transport rolls can drag the sheet over the surface of the non-moveable belt. This may cause irreparable damage to the sheet.

Accordingly, there is a need for further improvement in the sheet feeding apparatus of my copending application Ser. No. 529,455, so that an even more reliable bottom level document feeding apparatus is provided.

SUMMARY OF THE INVENTION

The present invention answers that need by providing an improved bottom level sheet feeding apparatus having an endless belt conveyor and means for lowering and raising both the upstream end and the downstream end of that belt relative to a fixed height pinch point. In this manner it is possible to minimize the problems associated with reverse shingling and with possible sheet damage at the downstream end of the feed mechanism. And yet, the apparatus of the present invention remains relatively inexpensive to manufacture and maintain in proper working order. It is more reliable relative to prior art devices and therefore minimizes machine downtime and waste.

As in my copending application Ser. No. 529,455, the present bottom level sheet feeding apparatus includes a tray as a receiving means for receiving a stack of sheets, a feed belt extending partially into the tray, a lead surface plate superposed to the belt conveyor downstream of the tray and inclined upwardly from the belt to form a pinch point therewith, an idler roller positioned to support the belt directly beneath the pinch point, and a conformable retard strip superposed to the belt conveyor downstream of the lead surface plate. The outer surface of the belt comprising the belt conveyor has a relatively high coefficient of friction for conveying a lowermost sheet of a set of sheets in the tray from the tray through the pinch point and past the retard strip. The lead surface plate has a relatively low coefficient of friction against the paper sheets so as to allow the sheets to move downwardly as successive ones of the lowermost sheets of the set are conveyed downstream of the tray by the belt. The retard strip has a coefficient of friction against paper which is lower than that of the belt but higher than that between overlying sheets so that sheets superposed to the lowermost sheet passing through the pinch point are retained by engagement of their leading edges and upper surfaces with the retard strip and are prevented from being conveyed further downstream by the belt. When a set of sheets is placed within the tray and urged downstream by the belt conveyor, their leading edges contact the lead surface, and the sheets are wedged downwardly toward the pinch point for separation. For this purpose, the lead surface plate preferably makes an angle with the feed belt which is between about 40° and 50°.

As in my copending application, the present invention will function satisfactorily when the upper run of the belt conveyor is substantially horizontal, but the efficiency is optimized when the feeding apparatus is arranged such that the upper run of the belt conveyor is inclined downwardly from the receiving tray, preferably making an angle of about 10° with the horizontal. In a preferred embodiment, the retard strip is made of a thin, microcellular, polyurethane foam and is mounted to the bottom surface of a block of foam or other relatively flexible spongy material. A retard strip of this construction can be mounted to the sheet feeding apparatus such that the foam strip rests lightly upon the portion of the upper run directly beneath it. As sheets are conveyed between the retard strip and the belt, the leading edges of the sheets superposed to the lowermost sheet engage the retard strip successively, and form a stepped arrangement. The flexibility of the spongy material supporting the retard strip permits the retard strip to conform to this stepped configuration and prevent the sheets superposed to the lowermost sheet from being conveyed further.

In my copending application, the puller or transfer rolls and the belt are driven by a common drive means. However, in many instances it is desirable to have the two independently driven, as shown herein. The preferred arrangement involves independently driven puller rolls which are continuously rotating when the power to the feeding apparatus is on. Separate drive means, then, are used to rotate the belt drive roller which may be the downstream roller positioned beneath the retard strip. The upstream roller, positioned beneath the tray, then, would be a follower roller.

Both the drive roller and the follower roller may be lowered and raised relative to the idler roller, which is, as mentioned, at a fixed height to form the pinch point. Thus, the belt drive roller and follower roller may be carried on axles which extend at the ends thereof through slots in the frame for the feeding apparatus. The very ends of axles, then, may be connected, preferably by a ball bearing arrangement or bushings, to a member which is moveable vertically relative to the frame. A solenoid or hydraulic piston may be used to move the moveable members, and thus lower or raise the drive and follower rollers.

Preferably, the solenoids or hydraulic pistons for lowering or raising the drive roller are controlled separately from those used for lowering or raising the follower roller. That is, in the idle or off mode the follower roller is lowered relative to the idler roller so that there is little of the upper run of the belt within the tray. After the stack of sheets has been positioned in the tray and upon activating the feed mechanism, the follower roller is raised. The upstream end of the belt is thereby raised so that the upper run is now in the tray for feeding the sheets as described above.

Since the upper run of the belt was not in the tray when the stack of sheets was loaded therein, the surface friction of the belt cannot contribute to the reverse shingling problem. Likewise, since the upper run of the upstream end of the belt is not raised into the tray until after the stack of sheets has been loaded in the tray, most likely it will upon being raised contact only the bottom most sheet. Thus, the bottom most sheet will be the one having the principal force of the moving belt applied thereto and, should, therefore, be the first fed. Even if it is not the case, the chances of an uncorrectable misfeed because of reverse shingling is greatly minimized. Finally, the lowering of the upstream end of belt below the tray after each feed reduces the contact with the succeeding sheet in the stack and minimizes the chances of a multi-feed. Upon raising of the belt, the cycle begins again and the next sheet is, then, fed.

At the downstream end of the belt conveyor means, the drive roller is normally in the raised position relative to the idler roller. That is, the upper run of the belt is positioned one sheet thickness below the retard pad and the furthest extent of the downstream end of the belt is adjacent the nip of the puller rolls and in line therewith. In this mode the separately driven puller rolls pick up any sheet entering their nip and transports it through the rest of the copying mechanism.

A sensor which may be a photoelectric gap control sensor is located between the furthest extent of the downstream end of the belt and the puller rolls to detect multi-feeds or misfeeds at this point in the feed mechanism. If a multi-feed or misfeed is detected, the belt drive roller is stopped and it is lowered by use of the moveable members connected thereto. This will prevent the feeding of additional sheets into the puller rolls. Any sheet which is in the nip of constantly driven puller rolls will continue through the mechanism, but it cannot couple to the belt (which has been lowered) and will not, therefore, cause continued movement of the belt. In this manner, no damage to the sheets is caused by the shutdown on a misfeed detection and yet the shutdown is instantaneous in terms of the stoppage of the belt.

Accordingly, it is an object of the present invention to provide an improved bottom level sheet feeding apparatus having means for raising and lowering both the upstream end and the downstream end of an endless belt conveyor means relative to a fixed pinch point located directly beneath the lead surface of a retard strip means.

Other objects and advantages of the invention will become apparent from the following description, the accompanying drawings and the appended claims.

DESCRIPTION OF THE PREFERRED EMBODIMENTS

Figure 1:
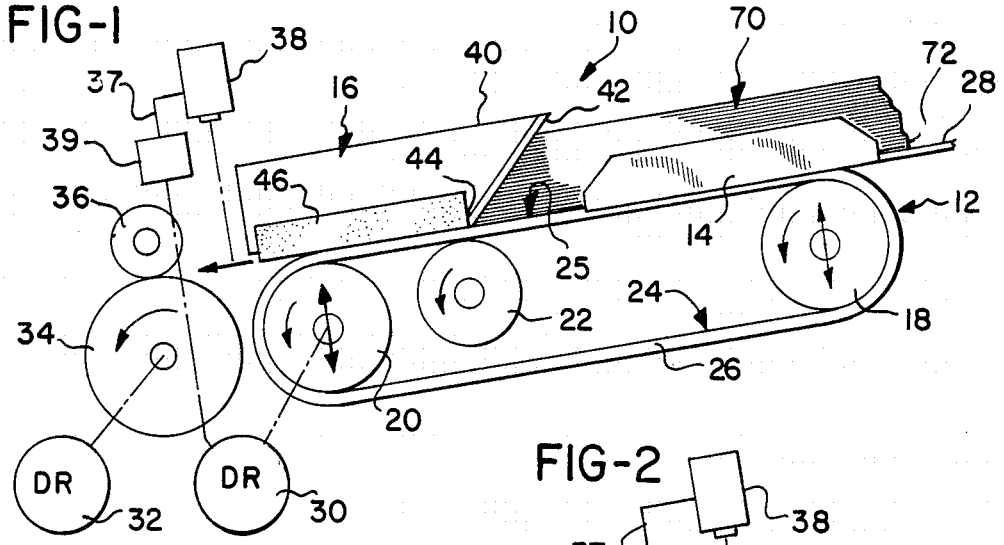
FIG. 1 is a somewhat schematic side elevation of the improved bottom level sheet feeding apparatus of the present invention.

As shown in FIG. 1, the bottom level sheet feeding apparatus, generally designated 10, comprises a belt conveyor 12, a sheet receiving tray 14, and a pad mounting block 16. The belt conveyor 12 includes a follower roller 18, positioned beneath the tray 14, a belt drive roller 20, positioned beneath the pad mounting block 16, and an idler roller 22. A belt 24 is entrained about the rollers 18, 20 and 22 and includes an outer surface 26 which, when passing through the tray 14, is elevated slightly above the floor 28 so that it may engage sheets contained therein.

The outer surface 26 of the belt 24 preferably has a relatively high coefficient of friction when contacting a sheet of paper. Particularly desirable results may be obtained with coefficients of between 1.2 to 1.5. A preferred material is isoprene.

Belt drive roller 20 is driven by a drive means of a known type illustrated schematically as drive 30. A similar, but separate drive means 32 is used to drive puller roll 34 which engages corresponding puller roll 36 in a pinch-nip arrangement so as to pick up and transport sheets emerging from the mounting block 16 at the extreme downstream end of belt conveyor 12. Such sheets are conveyed to associated copying apparatus (not shown), which do not constitute a part of the invention.

A sensor such as photoelectric gap control sensor 38 is located above the space between puller rolls 34, 36 and the extreme downstream end of belt conveyor 12.

As shown in FIG. 1, the tray floor 28 and upper run 25 of the conveyor belt 24 together define a paper path which is inclined downwardly from the tray 14 at an angle relative to the horizontal. Optimum results have been achieved when this angle of inclination is approximately 10°, although angles as high as 80° have yielded satisfactory results.

The pad mounting block 16 includes a body 40 having a lead surface plate 42 mounted to the end thereof which faces the tray 14 as set forth in my copending application Ser. No. 529,455. The lead surface plate 42 is inclined upwardly from belt 24 and makes an angle with the upper run 25 of between 30° and 60° and more preferably between 40° and 50°. Optimum results have been achieved when this angle is very close to 45°. The lead surface plate is made of a material having a relatively low coefficient of friction with paper, such as, for example, a beryllium copper alloy or an ultra high molecular weight material such as acetal resin. Preferably the coefficient of friction against paper is 0.2 or less.

As also shown in FIG. 1, the lead surface plate 40 includes a lower edge which is located above belt 24 at a position so as to lightly contact outer surface 26 along a line directly above the idler roller 22. The idler roller 22 supports the belt 24 directly beneath the lower edge to form a pinch point 44 for inhibiting the passage of multiple sheets of paper.

The pad mounting block 16 also includes a retard strip 46 which extends from lead plate 42 downstream beneath the body 40. The retard strip is made of a material having a coefficient of friction against paper that is somewhat less than the coefficient of friction of the outer surface 26 of the belt 24. A frictional coefficient of about 0.5 has been found to be satisfactory. A preferred material is a strip of microcellular polyurethane foam approximately 0.030 inches (0.762 mm.) thick.

Figure 4:
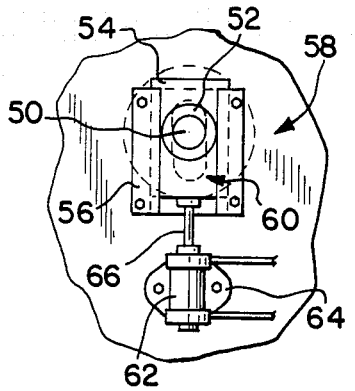
FIG. 4 is a partial side plan view of the frame for the bottom level feeding apparatus showing a moveable member attached to one of the lowerable and raisable rollers for the belt.
Figure 5:
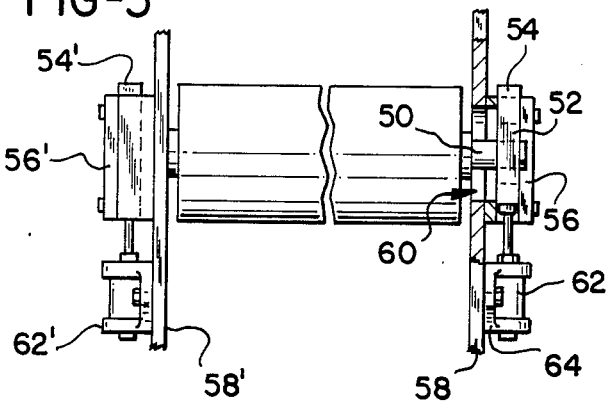
FIG. 5 is a broken-away end plan view of one rollers for the belt, showing the moveable members used to lower and raise the roller.

As illustrated in FIG. 1, follower roller 18 and belt drive roller 20 are lowerable and raisable relative to fixed idler roller 22. Means for doing so is shown in FIGS. 4–5. Thus, axle 50 is attached by a bushing or bearing 52 to moveable member 54 which is slideably mounted in a block 56 attached to frame 58. Frame 58 has slots 60 formed therein to allow for vertical movement of axle 50 therein. Moveable member 54 is connected to a means to move it, which is illustrated in FIGS. 4–5 as piston 62, mounted to frame 58 by bracket 64, and controlled by a servo mechanism (not shown). A solenoid may be used in place of piston 62. Pusher-puller rod 66 is the connector between piston 62 and moveable member 54. Identical piston 62', moveable member 54', etc. are located at the other end of axle 50. A similar arrangement may be used with both follower roller 18 and belt drive roller 20, except, of course, belt drive roller 20 will also have means for attachment to drive 30.

In operation, a stack of sheets 70 is placed in the tray 14 so that a lowermost sheet 72 rests upon the floor 28. At this point in time, the upstream end of upper run 25 of belt 24 is beneath floor 28 since follower roller 18 is in its lowered position. When activated, follower roller 18 is raised and drive 30 rotates belt driver roller 20. The linear movement of the upper run 25 urges the sheets forwardly toward the pad mounting block 16 thereby causing the leading edge of the stack of sheets 70 to come into contact with lead surface plate 42. Thereafter, continuing forward movement of the sheets during the feeding operation causes the sheets to be wedged forwardly and downwardly between plate 42 and belt 24 and shingled into the pinch point 44. The inclination of upper run 25 reduces inter-sheet frictional coupling forces and facilitates the forward and downward wedging of the sheets.

Sheet 72, thus, should be the first sheet fed into pinch point 44. Once it has been fed, follower roller 18 is lowered until time for the feed of the next sheet, when it is again raised and the cycle starts over. Continued movement of belt 24 conveys lowermost sheet 72 through pinch point 44, where it passes between the outer surface 26 of the upper run 25 and the retard strip 46. Since retard strip 46 is spongy, it can deform away from the outer surface 26 to allow the passage of the lowermost sheet 72 therebetween.

Should a sheet immediately above the lowermost sheet 72 pass through the pinch point 44 as well, the leading edge and upper surface of this sheet will contact the retard strip 46 and be held thereby, thus separating from the lowermost sheet 72. This is accomplished because the coefficient of friction between the upper sheet and the retard strip 46 is greater than the coefficient of friction between the upper sheet and lowermost sheet 72. Furthermore, the coefficient of friction between the lowermost sheet 52 and the outer surface 26 of the belt 24 is greater than the coefficients of friction between the lowermost sheet and either the retard strip 46 or the upper sheet. Thus, the lowermost sheet 72 is conveyed by the belt 24 past both the upper sheet and retard strip 46.

In addition, the reduced frictional surface of upper run 25 at the upstream end, as a result of the lowering of follower roller 18, will reduce the force on all but lowermost sheet 72. When this is considered with the fact that the tray 14 and lead surface plate 42 are configured as discussed, and the fact that the follower roller is lowered in the "off" mode, it can be seen that the problem of reverse shingling is greatly reduced by the instant invention.

Figure 2:
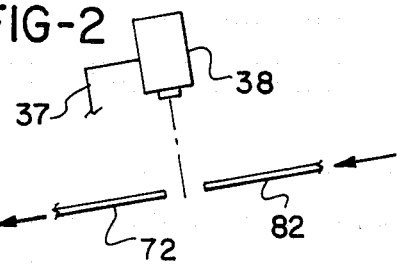
FIG. 2 is a schematic illustration of the operation of a gap control sensor as used to detect misfeeds in the improved bottom level sheet feeding apparatus of FIG. 1.
Figure 3:
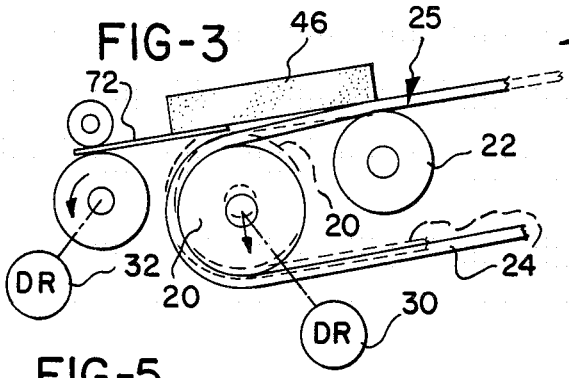
FIG. 3 is a schematic illustration of the lowering of the downstream end of the belt conveyor means in the apparatus of FIG. 1.

At the other end of the bottom level sheet feeding apparatus 10, gap control sensor 38 is used to detect multi-feeds, as illustrated in FIG. 2. Thus, if gap control sensor 38 fails to detect a gap at the appropriate time (following detection of the leading edge of sheet 72 passing thereby and before seeing the appearance of the leading edge of sheet 82), drive 30 is halted via control line 37 and controller 39 and a servo mechanism (not shown) is activated by the same controller 39 to lower belt drive roller 20. As illustrated in FIG. 3, the degree to which upper run 25 of belt 24 is lowered as a result thereof is small. However, it is sufficient to create a space between retard strip 46 and upper run 25 so that sheet 72 does not couple to belt 24. This allows sheet 72 to continue on its path and be conveyed to the copying apparatus, while the feed of all subsequent sheets is stopped. Upon clearing of the misfeed, the reset mechanism results in the raising of belt drive roller 20 and the operation continues.

While the forms of apparatus herein described constitute preferred embodiments of this invention, it is to be understood that the invention is not limited to these precise forms of apparatus, and that changes may be made therein without departing from the scope of the invention.

What is claimed is:

1. A bottom level sheet feeding apparatus comprising:

means for receiving a stack of paper sheets and having a floor for supporting a stack of sheets;

endless belt conveyor means including an upstream roller positioned beneath said receiving means, a downstream roller, an idler roller intermediate said upstream and downstream rollers, means for driving said rollers and belt means entrained about said rollers, said belt means having a coefficient of friction with paper greater than a coefficient of friction between sheets of paper and an upper run defined by said rollers and extending into said receiving means for conveying sheets therefrom;

lead surface means extending upwardly from said upper run and terminating above said idler roller to form a pinch point with said upper run which approximates a thickness of a sheet of paper;

retard strip means superposed to said upper run and said downstream roller downstream of said lead surface means and having an outer surface with a coefficient of friction with paper less than that of said conveyor means;

a pair of driven puller rolls located downstream of said retard strip means and said endless belt conveyor means and forming a nip positioned to receive a sheet conveyed from a downstream end of said conveyor means, said puller rolls being driven independently of said conveyor means;

means for selectively raising and lowering said upstream roller relative to said floor independently of said downstream roller so that an upstream end of said upper run may be raised into contact with a lowermost sheet in said receiving means to convey that sheet to said pinch point, or lowered to disengage sheets in said receiving means;

means for selectively raising and lowering said downstream roller independently of said upstream roller so that a downstream end of said upper run may be moved downwardly from said retard strip means such that a sheet therebetween is not conveyed thereby, or upwardly substantially against said retard strip means such that a sheet therebetween is held against said upper run and is conveyed thereby;

means for sensing a gap in sheets occurring between said downstream end of said conveyor means and said puller rolls; and means responsive to said sensing means for stopping said roller driving means, thereby stopping said conveyor means, and actuating said downstream raising and lowering means to lower said upper run from said retard strip means to allow a sheet to be pulled from between said upper run and said retard strip means by said puller rollers when said sensing means not does detect a gap at a predetermined time interval.

2. The apparatus of claim 1 wherein said raising and lowering means for each of said upstream and downstream rollers includes a pair of fixed blocks and a pair of members slidably attached to said blocks and rotatably connected to the ends of said upstream and downstream rollers, and said selective raising and lowering means includes means for vertically displacing said members relative to said blocks.

3. The apparatus of claim 1 wherein said downstream roller comprises a drive roller coupled directly to said driving means.

4. The apparatus of claim 3 wherein said lead surface means forms an angle with said upper run of between 30° and 60°.

5. The apparatus of claim 4 wherein said upper run is inclined downwardly from said receiving means at an angle of about 10° with the horizontal.

6. The apparatus of claim 5 wherein said retard means is sufficiently flexible to conform to and contact leading edges of sheets conveyed thereunder.

* * * * *